United States Patent [19]

Switall et al.

[11] Patent Number: 4,815,375

[45] Date of Patent: Mar. 28, 1989

[54] SPRAY DAMPENING SYSTEM HAVING ALTERNATE APPLICATION CONTROL

[75] Inventors: Thomas G. Switall, Kildeer; Michael Schaefges, Wheeling; Alan Goetzelman, Prospect Heights, all of Ill.

[73] Assignee: Ryco Graphic Manufacturing, Inc., Wheeling, Ill.

[21] Appl. No.: 183,266

[22] Filed: Apr. 11, 1988

Related U.S. Application Data

[63] Continuation of Ser. No. 919,385, Oct. 16, 1986, abandoned, which is a continuation-in-part of Ser. No. 870,657, Jun. 2, 1986, Pat. No. .4,649,818, which is a continuation of Ser. No. 757,193, Jul. 22, 1985, abandoned, which is a continuation of Ser. No. 518,470, Jul. 29, 1983, abandoned.

[51] Int. Cl.[4] ..... B41F 7/30

[52] U.S. Cl. ..... 101/148

[58] Field of Search ..... 101/148, 147, 365, 366, 101/350, 363

[56] References Cited

U.S. PATENT DOCUMENTS

| | | | |
|---|---|---|---|
| 3,747,524 | 7/1973 | Crum | 101/365 |
| 4,469,024 | 9/1984 | Schwartz et al. | 101/366 X |
| 4,508,034 | 4/1985 | Bolza-Schünemann | 101/365 |

*Primary Examiner*—J. Reed Fisher

*Attorney, Agent, or Firm*—Lee & Smith

[57] ABSTRACT

A spray dampening system for use in a printing operation including solenoid-operated spray dampening fluid nozzles operated at particular frequencies in relation to the speed of the press. The nozzles are operated in pairs, such that only one of the nozzles of each pair is activated at any one time. The frequency of alternation of activation of the nozzles of each pair is dependent upon the speed of the printing operation.

16 Claims, 4 Drawing Sheets

SPRAY DAMPENING SYSTEM HAVING ALTERNATE APPLICATION CONTROL

RELATED APPLICATION

This application is a continuation of U.S. patent application Ser. No. 919,385, filed Oct. 16, 1980, now abandoned, which in turn is a continuation-in-part of U.S. patent application Ser. No. 870,657, filed June 2, 1986, now U.S. Pat. No. 4,649,818, which in turn is a continuation of U.S. patent application Ser. No. 757,193, filed July 22, 1985, now abandoned, which is a continuation of U.S. patent application Ser. No. 518,470, filed July 29, 1983, now abandoned.

BACKGROUND OF THE INVENTION

The present invention relates in general to a system for controlling the application of a solution to printing press rollers, and more particularly to an improved apparatus for applying wetting solution to the press in a controlled manner in relation to the speed of the press.

As explained in our co-pending U.S. patent application Ser. No. 870,657, filed June 2, 1986, now U.S. Pat. No. 4,649,818, the disclosure of which is incorporated herein by reference, in modern printing processes, an application of a wetting solution and ink are applied to certain rollers of the process with the ink subsequently being transferred to a printed medium, such as paper. The setting solution is applied in sufficient quantities to the rollers of the press to facilitate the printing process and aid in proper application of the ink to the printed paper.

Control of the amount of wetting solution on the inking roller is extremely important. As explained in referenced patent application Ser. No. 870,657, insufficient wetting tends to encourage the ink to migrate to improper portions of a roller and thereby be transferred to areas of the paper which are not to be printed. If an excess of wetting solution is applied, there is waste and possible wetting of the paper being printed. A smooth, even application of the wetting solution without excess is a desired result of any spray dampening system.

The spray dampening system of parent application Ser. No. 870,657 provides an exemplary application of wetting solution. However, because the spray nozzles of the system are located adjacent one another and simultaneously apply the wetting solution to the press rollers, overlap of the spraying areas of adjacent spray nozzles is practically inevitable. If the overlap is too great, an excess of dampening solution will result, with the attendant disadvantages. The purpose of this invention is therefore to overcome the possibility of unadvantageous overlap of the spray patterns of adjacent spray nozzles.

SUMMARY OF THE INVENTION

The invention includes a spray dampening system for delivering a dampening fluid through a bank of solenoid-operated spray nozzles to a moving surface of a printing operation. The dampening system has a control system for operating the solenoids which is responsive to the speed of the printing operation. The control system includes individual drivers for operating the solenoid of each spray nozzle. In accordance with the invention, there is provided means for operating the individual driver means in pairs such that only one driver means of each pair is activated at a time.

The operating means includes a gate connected to each of the drivers, and also includes a gate operator having first and second outputs. The gate operator includes means for activating only one of the outputs at a time. The first output is connected to one gate of each pair of the drivers and the second output is connected to the other gate of each pair of the drivers. Preferably, the gate operator comprises a bistable multivibrator.

The invention includes a microcontroller, available from many commercial sources, in place of the assembled components of parent application Ser. No. 870,657. The microcontroller is connected to control the solenoids through their respective gates, and is also connected to the multivibrator to pulse the multivibrator, thereby causing the alternation of activation of the spray nozzles of each pair.

The microcontroller can be remotely operated. A signal transmitter and a signal receiver are connected thereto for control at large distances.

As is customary with any microcontroller, a program is provided to control the operations of the microcontroller. The program preferably is provided on an EPROM connected to the microcontroller in a conventional fashion.

BRIEF DESCRIPTION OF THE DRAWINGS

The invention is described in greater detail in the following description of examples embodying the best mode of the invention, taken in conjunction with the drawings, in which.

DESCRIPTION OF EXAMPLES EMBODYING THE BEST MODE OF THE INVENTION

Figure 1:
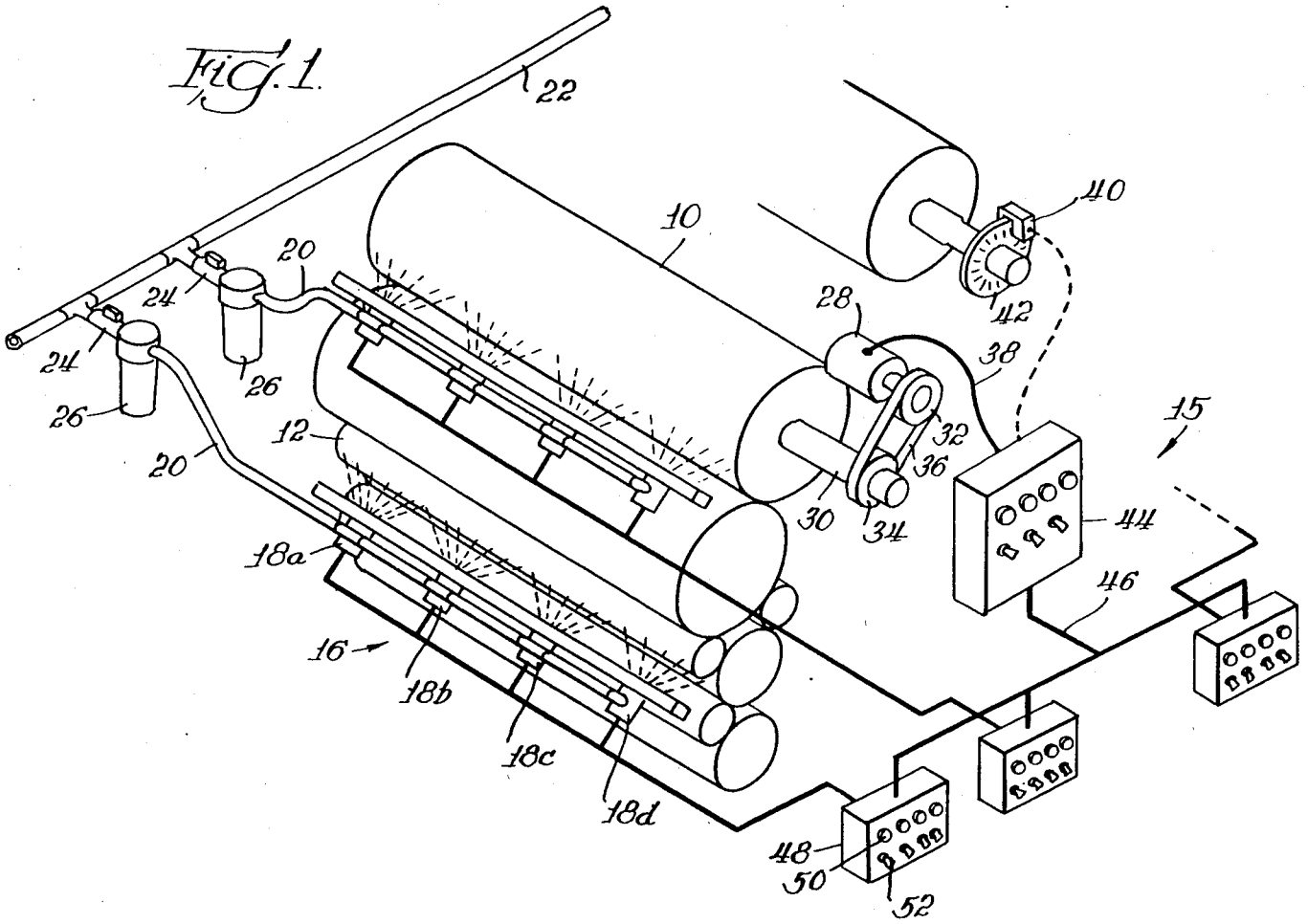
FIG. 1 is a generalized block perspective view of a portion of a printing operation, illustrating incorporation of the spray dampening control system of parent application Ser. No. 870,657.

Referring now to FIG. 1, there is shown a typical printing operation including various rollers such as a plate cylinder 10, and an inking roller 12 both rollers of which require the application of a dampening fluid to the surfaces thereof for the proper transfer of the photoengraved image on the plate cylinder 10 to the paper (not shown). While different printing operations may require fewer or more rollers than shown in FIG. 1, it is sufficient to realize that irrespective of the particular printing operation the application of spray dampening solution to roller surfaces is required to effect a proper transfer of ink from the offset plate cylinder to the paper medium. Other printing operations, such as folding machines, can advantageously utilize the principles of the present invention to facilitate the folding operation.

The spray dampening control system, generally designated 15, includes one or more solenoid-operated spray nozzle bars, one shown as reference character 16. In the exemplary printing operation, spray bar 16 includes four solenoid-operated spray nozzles **18*a*, 18*b*, 18*c*, 18*d*, spaced apart from each other and from the inking roller 12, such that the spray jet emitted from the nozzles uniformly covers the surface of such roller. For the sake of clarity the inking system for applying the oil base ink to the inking roller 12 is not shown. Each solenoid controlled spray nozzle, being of well-known and conventional design, has an input plumbed to a liquid supply line 20**. The electrically controlled nozzles used with the present invention are of the normally off type where the application of an electrical signal opens the nozzle valve to allow the pressurized liquid to be sprayed for the duration of the signal. Electrically controlled nozzles of this type, being either fully on or off, provide a constant angle of spray when activated and thus maintain a constant area of coverage even though the volume of liquid sprayed may be reduced. With this arrangement the volume of liquid sprayed is increased either with an increase in frequency, or by an increase in the duration of the electrical signal.

A main liquid supply conduit 22 provides spray dampening fluid at a pressure of about 75–90 pounds to the supply lines 20 through respective shut off valves 24 and filters 26. In keeping with the invention, a conventional liquid pressure pump (not shown) supplies the spray dampening fluid to the spray bars 16 at a constant pressure without regard to the speed of the printing operation. In this manner expensive pressure regulating apparatus for varying the fluid pressure according to press speed is eliminated, along with the attendant maintenance problems.

In the preferred embodiment of the invention a measure of the speed of the printing operation is derived from a tachometer generator 28 which is coupled to a shaft 30 of the plate cylinder 10 by pulleys 32 and 34, and a drive belt 36. Tachometer generator 28 is a conventional design having an output voltage range of about 0–50 volts and varies linearly according to the angular velocity of the plate cylinder 10. With this arrangement the speed with which paper is printed, and thus processed through the printing operation, is in direct correspondence with the tachometer generator output. The output voltage of the generator 28 is coupled to the spray dampening control system 15 by electrical wires 38. Of course, the tachometer generator 28 can be conveniently coupled to other printing rollers to provide an indication of the printing operation speed. With the current demand for printed matter, and the desire of increase the output of printing operations without the costly purchase of additional presses, the speeds of printing presses are not surprisingly operating at maximum speeds of approximately 50,000–70,000 papers per hour.

As an option to the tachometer generator input to the spray dampening control system 15 a Hall effect proximity sensor 40 may be employed to sense the angular velocity of the roller shaft and produce a pulse train with a frequency representative of the angular velocity of the shaft. According to the operation of standard Hall effect proximity sensors the number of pulses per unit of time, and thus the frequency generated, is a function of the number of apertures angularly spaced around the wheel 42. An optical light source and detector may be used with equal advantage with the apertured wheel 42 to produce a pulse repetition rate representative of the printing press speed.

According to the invention the spray dampening control system 15 includes, together with the spray bars 16, a master control unit 44 for converting the analog voltage output of the tachometer generator 28, or the pulse frequency of the proximity sensor 40, into an output frequency on an electrical bus 46.

A plurality of spray bar drivers, one shown at reference character 48, receive the master control output frequency on distribution bus 46 and drive the solenoids of the spray nozzles associated with the respective spray bar. Each spray bar driver 48 is capable of individually driving the four solenoid-operated spray nozzles 18*a–d* with a frequency as determined by the master control unit 44 and is thereby able to regulate the volume of liquid sprayed from each nozzle. As explained in parent application Ser. No. 870,657, the solenoid of each spray nozzle is further controlled in each spray bar driver circuit 48 by controlling the duty cycle of the electrical pulse without affecting the frequency of such pulses as generated by the master control unit 44. In addition, each spray bar driver circuit 48 includes a switch 52 associated with each spray nozzle for deactivating the particular nozzle and removing it from service. Also explained more fully is the manner in which each spray bar driver circuit is electrically isolated from each other, as well as from the master control unit 44 to prevent an electrical failure in one such unit from affecting other units.

Figure 2:
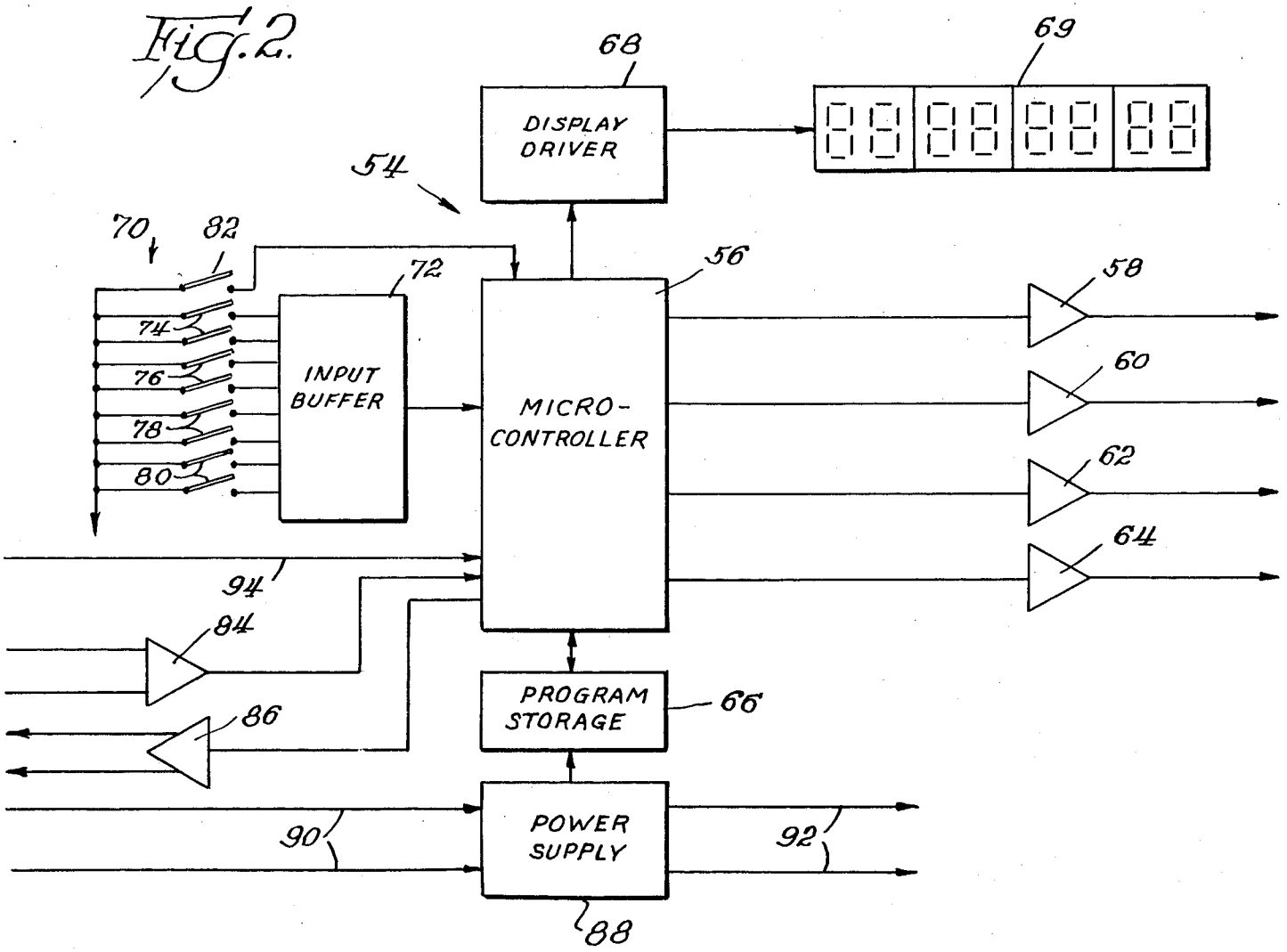
FIG. 2 illustrates in block form the circuitry, including a microcontroller, which may be used to replace the individual circuit components of parent application Ser. No. 870,657.

The circuitry of FIG. 2 is intended to replace the circuitry of FIGS. 2, 3, 7 and 8 of parent application Ser. No. 870,657. The spray dampening control system, generally designated 54, includes a microcontroller 56 connected to a series of drivers 58, 60, 62 and 64. The drivers 58–64 are identical to the drivers 53 of parent application Ser. No. 870,657 and are attached to respective solenoid spray nozzles 16 (FIG. 1) in a fashion identical to the parent application.

The microcontroller 56 may be a conventional microcontroller from one of the many manufacturers thereof. For example, the Intel 8031 or 8032 microcontroller, manufactured by Intel Corporation, provides a suitable microcontroller for the various functions of the invention. The Intel microcontroller has 128 bytes of internal random access memory. It also includes a serial communication port (not illustrated), which permits the microcontroller to be controlled remotely from another computer system.

As is conventional, the microcontroller 56 is program controlled. To provide that program control, a program storage 66 is connected to the microcontroller 56. The program may be contained in an EPROM which has been preprogrammed to control the functions of the microcontroller 56, as described in detail in referenced application Ser. No. 870,657, and as described below.

The microcontroller 56 also is connected to a display driver 68 which in turn is connected to a digital display 69. As in parent application Ser. No. 870,657, the display 70 is for displaying operational data, such as operating frequencies.

A plurality of switches 70 are employed for controlled the microcontroller 56. An input buffer 72 is used to scan for activation of one of the switches 70 connected thereto, and send a signal to the microcontroller 56 when a switch has been activated. For example, the pair of switches designated 74 may be connected for controlling the driver 58 (and therefore its associated nozzle 18 of the spray bar 16). For example, if a greater spray is required, the upper of the switches 74 can be closed momentarily. Conversely, if a lesser spray is required, the lower of the switches 74 can be closed to reduce the spray. Switch pairs 76, 78 and 80 can be used for similar control of the respective drivers 60, 62 and 64. Upper switch 82 of the switch bank 70 can be used for flood control of the roller 10. Activation of the switch 82, which is connected directly to the microcontroller 56, can control the spray bar 16 for initial flooding of the spray dampening fluid in a well known fashion.

As explained above, the microcontroller 56 may include a communications port (not illustrated) for remote control of the microcontroller 56. To that end, a receiver 84 and transmitter 86 are employed, and may be connected to a remote computer system (not illustrated). Utilization of transmitters 86 and receivers 84 promotes versatility by permitting interconnection of large numbers of dampening control systems 54 and also by permitting control of a system 54 from the remote computer or other source.

A power supply 88 is employed to activate the program storage 66, microcontroller 56, and any other element of the spray dampening control system 54 requiring power activation, as is conventional. Input to the power supply is provided on lines 90, while output of other components is on lines 92.

The input pulse signal to the microcontroller 56 is provided on a line 94. As explained above, the input pulse signal is provided by a tachometer generator 28 or similar device, such as the proximity sensor 40.

Figure 3:
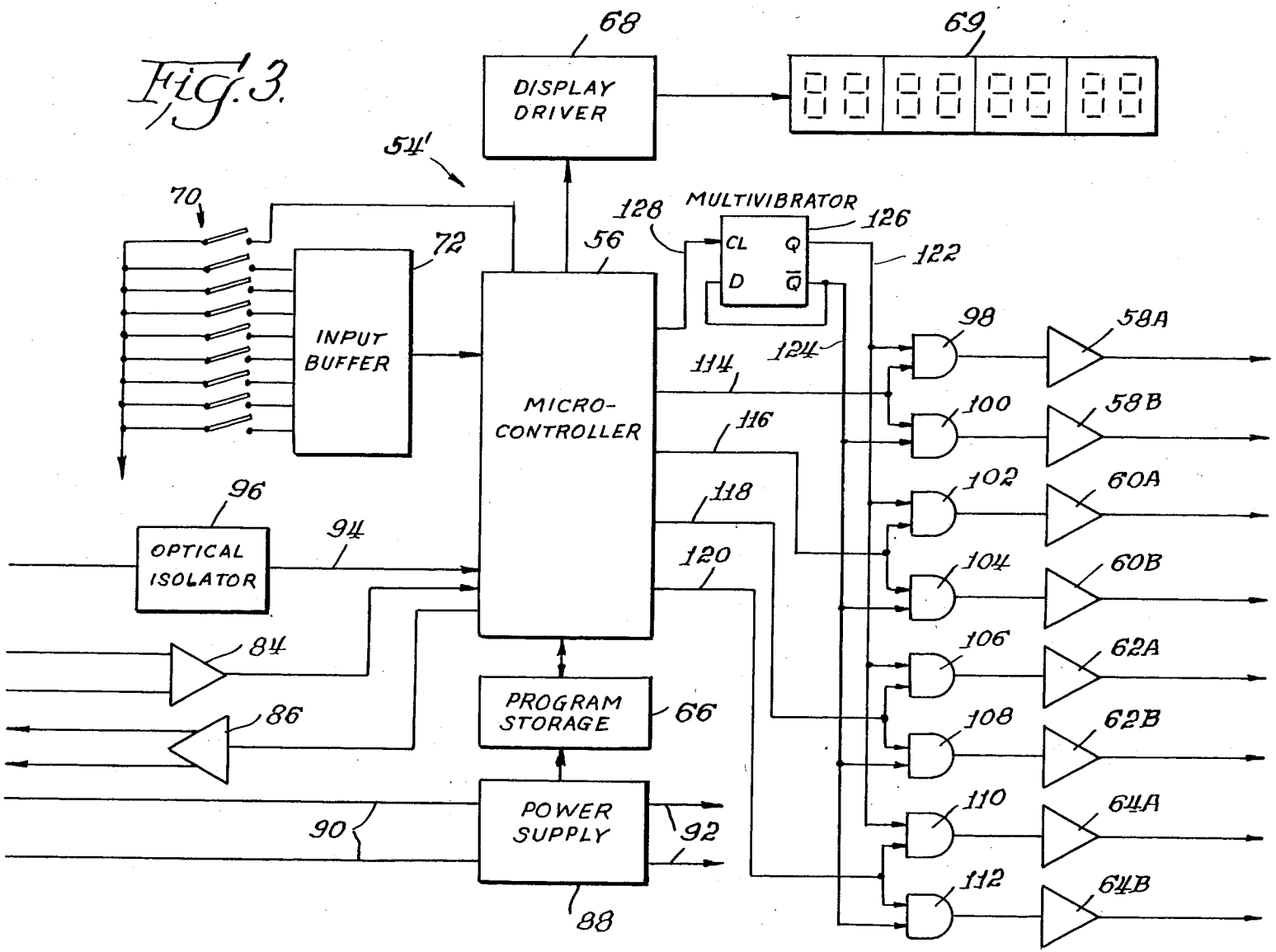
FIG. 3 is a circuit similar to FIG. 2, and further illustrating the alternation control according to the invention.

FIG. 3 illustrates one form of the invention for alternating control of the nozzles 18 of the spray bar 16. Since the majority of the components illustrated in FIG. 3 are identical to those illustrated in FIG. 2 and described above, those components bear identical reference numerals and will not be described in greater detail.

In order to isolate the microcontroller 56, an optical isolator 96 is installed in the line 94. The optical isolator 96 may be identical to, and serve the same function as the optical isolator in FIG. 7b of parent application Ser. No. 870,657.

The spray dampening system 54′ of FIG. 3 includes eight drivers 58A, 58B through 64A, 64B, in replacement of the four drivers 58–64 illustrated in FIG. 2. Each of the drivers 58A–64B receives an input from a respective and-gate 98 through 112. Each of the and-gates 98 through 112, in turn, receives one of four inputs 114 through 120 from the microcontroller 56 and also either the Q or $\overline{Q}$ on either line 122 or 124 from a multivibrator 126. The multivibrator 126, which may be a conventional D-type bistable multivibrator, or flip flop, receives an input to its clock terminal on line 128, also leading from the microcontroller 56.

The function of the microcontroller 56 is identical to that described above with regard to FIG. 2. In addition, the microcontroller 56 passes all input pulses on the line 94 to the multivibrator 126 via the line 128. Thus, for each input pulse to the microcontroller 56, the output state of the multivibrator 126 is changed.

As seen from FIG. 3, activation of the drivers 58A and 58b is controlled through the and-gates 98 and 100 by the presence of an output on the line 114 and an output state of the multivibrator 126 on one of the lines 122 snd 124. If an output appears on the line 114 and, for example, the Q output of the multivibrator 126 is high, the and-gate 98 activates the driver 58A, while the driver 58B remains unactivated as there is no output from the and-angle 100 (due to the $\overline{Q}$ output of the multivibrator 126 being low). If the multivibrator 126 is pulsed at its clock input, the state of the multivibrator 126 changes, and the $\overline{Q}$ output is high, with that output being directed on the line 124. If an output appears on line 114 from the microcontroller 56, it will be evident that the driver 58B will be activated, while the driver 58A will then be deactivated.

The functioning of the drivers 60A, 60B, 62A, 62B and 64A, 64B is identical to that of the drivers 58A, 58B. Each of the paired drivers 58A through 64B is controlled by a respective output line 114 through 120 from the microcontroller 56, and also the state of the multivibrator 126. Therefore, due to the circuit configuration, it is evident that either drivers 58A, 60A, 62A and 64A are capable of being activated at one time or drivers 58B, 60B, 62B and 64B are capable of being activated. Consequently, since the drivers 58A through 64B are connected to respective adjacent solenoid-operated spray nozzles of the spray bar 16, it will be evident that adjacent nozzles are never activated concurrently.

Figure 4:
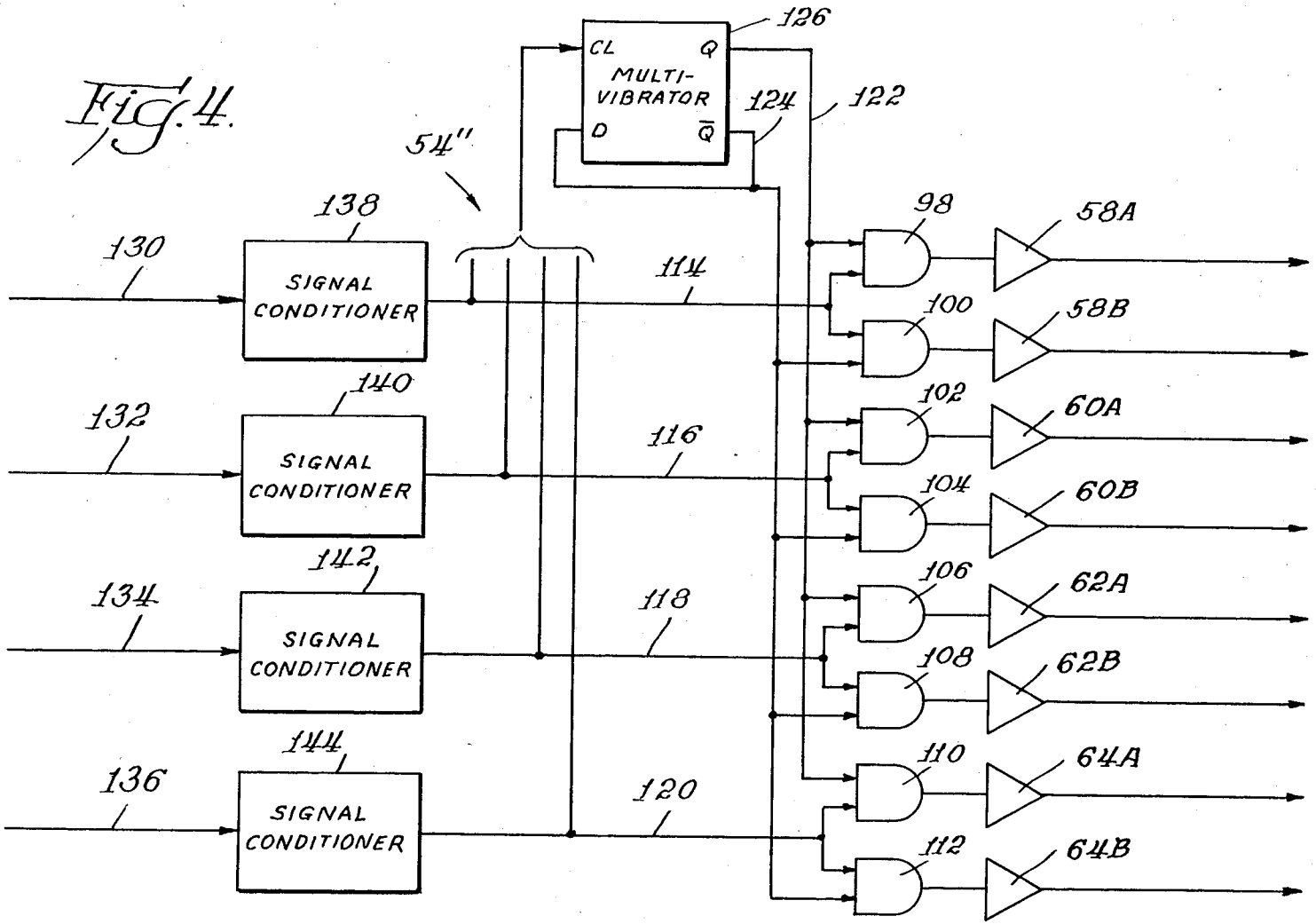
FIG. 4 illustrates an alternation control which can be incorporated into an already-installed system such as that of parent application Ser. No. 870,657.

FIG. 4 illustrates a spray dampening control system 54″ which is intended to be employed to modify, for example, the four nozzle spray bar control of parent application Ser. No. 870,657 to the form and function of the eight nozzle control illustrated in FIG. 3.

Each spray bar driver 48 includes an output on four lines to the respective spray nozzles 18*a* through 18*d* of the spray bar 16. With reference to FIG. 4, rather than connecting the outputs directly to the spray bar 16, the four outputs, on lines 130 through 136, are directed first to respective signal conditioners 138 through 144. Each signal conditioner may comprise an optical isolator, identical to the optical isolater 96, and the purpose of the signal conditioner is to reduce the input voltage on the lines 130 through 136 to a level acceptable by the and-gates 98 through 112 and the multivibrator 126.

The outputs of the signal conditioners 138 through 144 are directed on respective lines 114 through 120 to the and-gates 98 through 112. In addition, each of the outputs of the signal conditioners 138 through 144 is directed to the clock input of the multivibrator 126. Thus, for each pulse on one of the lines 130 through 136, the multivibrator 126 is pulsed, changing its output state. The function of the multivibrator 126 and the and-gates 98 through 112 of FIG. 4 is identical to that of the same components of FIG. 3. Reference to the detailed description above will explain the functioning of these components.

The spray dampening control system according to the invention improves that of parent application Ser. No. 870,657 by providing a system where adjacent spray nozzles are not activated, thus avoiding the potential for spray overlap from adjacent nozzles. Various changes can be made to the invention without departing from the spirit thereof or scope of the following claims.

What is claimed is:

1. In a spray dampening system for delivering a dampening fluid through a bank of solenoid-operated spray nozzles to a moving surface of a printing operation, the dampening system having a control system for operating the solenoids which is responsive to the speed of the printing operation, the control system including individual driver means for operating each solenoid, the improvement comprising means for operating the individual driver means in pairs such that only one driver means of each pair is activated at a time, said operating means including means responsive to a representation of the speed of the printing operation and connected to the driver means for alternating operating one driver means of each pair of driver means such that adjacent spray nozzles are not activated simultaneously.

2. A spray dampening system according to claim 1 in which said operating means includes a gate connected to each driver means, and including a gate operator having a first and a second output, said gate operator including means for activating only one of said outputs at a time, said first output being connected to one gate of each pair of driver means and said second output being connected to the other gate of each of driver means.

3. A spray dampening system according to claim 2 in which said gate operator comprises a bistable multivibrator.

4. A spray dampening system according to claim 1 including a controller connected to each pair of driver means for providing operating signals thereto, and in which said operating means includes a multivibrator having one output connected to one driver means of each said pair and a second ouput connected to the other driver means of each said pair.

5. A spray dampening system according to claim 4 including means for remotely operating said controller.

6. A spray dampening system according to claim 5 in which said means for remotely operating includes a signal transmitter and a signal receiver connected to said container.

7. A spray dampening system according to claim 4 including a program storage device connected to said controller for operating said controller.

8. In a spray dampening system for delivering a dampening fluid through a bank of solenoid-operated spray nozzles to a moving surface of a printing operation, the dampening system having a control system for operating the solenoids, which control system includes means responsive to the speed of the printing operation for producing a voltage representation of the speed and individual driver means for operating each solenoid, the improvement comprising means for operating the individual driver means in pairs, said operating means including means responsive to the voltage representation and connected to the driver means for alternatingly operating one driver means of each pair of driving means such that adjacent spray nozzles are not activated simultaneously, said means responsive including a gate connected to each driver means and a gate operator means connected to each pair at a time.

9. A spray dampening system according to claim 8 in which said gate operator means comprises a bistable multivibrator having first and second outputs, one of said outputs being connected to one gate of each pair of driver means and the other of said outputs being connected to the other gate of each pair of driver means.

10. A spray dampening system according to claim 9 in which said means for producing a voltage representation comprises a pulse generator and the pulses therefrom are connected to said multivibrator.

11. In a spray dampening system for delivering a dampening fluid through a bank of solenoid-operated spray nozzles to a moving surface of a printing operation, the dampening system having a control system for operating the solenoids which is responsive to the speed of the printing operation, the control system including means responsive to the speed of the printing operation for producing a voltage representation of the speed and an individual driver means for operating each solenoid, the improvement comprising a. means for operating the individual driver means in pairs, b. a controller for providing operating signals for controlling activation of the solenoids, c. means connecting the controller to each pair of driver means, and d. said operating means having means responsive to the voltage representation and connected to the driver means for alternatingly operating one driver means of each pair of driving means such that adjacent spray nozzles are not activated simultaneously.

12. A spray dampening system according to claim 11 in which said operating means includes a gate connected to each driver means for controlling each driver means, said connecting means being connected to each gate of each pair of driving means.

13. A spray dampening system according to claim 12 in which said means responsive to the voltage representation comprises a multivibrator having two outputs, one output being connected to one gate of each pair of driving means and the other output being connected to the other gate of each pair of driving means.

14. A spray dampening system according to claim 11 including means for remotely operating said controller.

15. A spray dampening system according to claim 14 in which said means for remotely operating includes a signal transmitter and a signal receiver connected to said controller.

16. A spray dampening system according to claim 11 including a program storage device connected to said controller for operating said controller.

* * * * *